United States Patent [19]

Kotob

[11] Patent Number: 4,920,524

[45] Date of Patent: Apr. 24, 1990

[54] MULTIMODE DIGITAL TIMEPIECE

[76] Inventor: Mohammed N. Kotob, 58 Princeton St., 2nd Flr., Bridgeport, Conn. 06605

[21] Appl. No.: 234,537

[22] Filed: Aug. 22, 1988

[51] Int. Cl.[5] ..... G04C 17/02

[52] U.S. Cl. ..... 368/240; 368/241

[58] Field of Search ..... 368/240–242, 368/223, 239

[56] References Cited

U.S. PATENT DOCUMENTS

| | | | |
|---|---|---|---|
| 3,958,409 | 5/1976 | Manber | 368/240 |
| 4,007,583 | 2/1977 | Johnson | 368/240 |
| 4,041,692 | 8/1977 | Marshino | 368/240 |
| 4,254,487 | 3/1981 | Lee | 368/280 |
| 4,370,068 | 1/1983 | Han | 368/240 |

FOREIGN PATENT DOCUMENTS

| | | | |
|---|---|---|---|
| 2341889 | 9/1977 | France | 368/240 |

*Primary Examiner*—Bernard Roskoski
*Attorney, Agent, or Firm*—Lorraine M. Donaldson

[57] ABSTRACT

The dial of a timepiece is provided with a first circular array of twelve blue LEDs indicating hours, a second next-outermost array of sixty red LEDs indicating minutes, and a third next-outermost array of sixty green LEDs indicating seconds. Every fifth red "minute" LED is distinct from the intermediate "minute" LEDs in that it is either spaced farther apart from the adjacent LEDs or is larger than the adjacent LEDs, or both. A switch is provided in the timing circuit of the timepiece to select between a "normal" mode of operation wherein the sixty "minute" LEDs are energized in sequence, at the passage of each minute and a "teaching" mode of operation wherein only every fifth "minute" LED is energized, in sequence, at the passage of each five minute interval. The timepiece may be a watch, a clock or the like.

4 Claims, 2 Drawing Sheets

MULTIMODE DIGITAL TIMEPIECE

TECHNICAL FIELD OF THE INVENTION

The invention relates to digital timepieces, such as watches, and, more particularly, to the display elements of the timepieces.

BACKGROUND OF THE INVENTION

Mankind has long felt compelled to measure the passage of time within a day. Early, pre-mechanical devices such as the sundial, marked candles and the hour glass addresses the desire, albeit in rather primitive ways. With the dawning of the mechanical age, gears and pendulums enabled the development of timepieces that we would recognize today. Early clocks were rather large and expensive, but in this century, mass-production and the mainspring brought the wristwatch within the grasp of the common man. In the last decade or so, electronic technology saw the introduction of the digital, numeric-readout watch. This seemed at once a marvel of technology, but people soon realized the ergonomic advantage of the traditional analog readout.

Various patents disclose digital timepieces. U.S. Pat. No. 3,841,082 discloses a binary clock wherein four lights indicate the hour according to the binary numbering system, four lights indicate the five-minute interval within an hour according to the binary numbering system, and four lights indicate the minute interval within a particular five-minute interval according to the decimal numbering system. This display requires special training to read since it does not correlate well to a traditional timepiece with hands.

Japanese Pat. No. 52-21864 discloses what we might call the "traditional" digital watch. A four-digit display indicates the hours (two digits) and the minutes (two digits).

U.S. Pat. No. 4,254,489 discloses a timepiece simulating a clock using dial hands. The hands, in this case, are sixty liquid crystal elements emanating radially from the center of the dial. While benefiting in readability as a more direct analog of mechanical hands, the liquid crystal elements are tightly packed, and spacing becomes a problem, especially towards the center of the dial. Also, the hands are not very visible in attenuated light.

U.S. Pat. No. 4,488,818 discloses a timepiece with a hybrid display of mechanical hands and a digital, numeric readout. The purpose of having two time displays within a single timepiece is to be able to view the time in two time zones simultaneously. The resulting "busy" display is unattractive to many people.

U.S. Pat. No. 3,854,279 discloses apparatus for indicating time including a plurality of electric lamps having different colors corresponding to different times of the day. Its outward appearance is more like a lamp than a clock, and the relationship of particular lamps being illuminated to time is rather obscure.

German Patent Publication No. 2,725,029 discloses a timepiece with an analog display using LEDs or liquid crystal cells arranged in a point or line raster. The display elements are coupled to an control circuit energizing time in sequence to provide an analog representation of the clock hands. The display comprises concentric rings divided into 60 segments, the different rings being used for the hours, minutes and seconds hands respectively.

German Patent Publication No. 2,751,551 discloses a watch with an analog LED or LCD display. As in the above mentioned U.S. Pat. No. 4,254,489, the display consists of elongated segments emanating radially from the center of the dial.

U.S. Pat. Nos. 4,075,826, 4,120,148, 4,448,544, 4,207,734 and 4,074,515 all disclose electronic circuitry controlling the operation of a digital timepiece.

A problem with the aforementioned timepieces is that they are not as easily readable as a traditional mechanical timepiece having radial hands circulating about a dial. There are several reasons for this. First is the high degree of visual contrast obtained from, for instance, black hands and a white dial. Even in those cases of electronic watches having LCD elements representative of hands, the elements are of necessity quite thin, and are lacking in the requisite contrast, due in part to the fact that the elements are in the plane of the dial, and the dial is very "busy" with quiescent elements. This is even more pertinent in the context of a watch. Small size is anathema to many of the aforementioned timepieces.

Another problem is that while the aforementioned electronic watches are technically quite sophisticated, we have become acclimated, such as through early exposure to mechanical wall clocks in school and at home, to the somewhat more primitive, imprecise readout of a mechanical timepiece with hands. While, for instance, a digital numeric-readout watch can indicate exactly what minute and second it is, such accuracy is typically not desired, and it is burdensome to have to read the digits. In contrast to this, one can tell at a glance the time from a mechanical timepiece; for instance, about a quarter after three, almost ten thirty, etc. When more precision is called for, we can tell the time to the minute, and even to the second if a second hand is provided.

The third problem, which relates back to the visual presentation, is that in mechanical timepieces the hands, hour, minute and second, are very distinctive, one from another. Thus we can focus, almost in a reflexive manner, upon the relevant hand(s). For instance, one may already know that he is within the hour of seven, and is only concerned with the minute hand to know when seven thirty arrives.

In summary, a common problem in the previous electronic readout timepieces is that too much cognition is required. SUMMARY OF THE INVENTION Therefore, it is an object of this invention to provide a timepiece having a more readable display.

According to the invention, the dial of a timepiece is provided with a first circular array of twelve blue LEDs indicating hours, a second next-outermost array of sixty red LEDs indicating minutes, and a third next-outermost array of sixty green LEDs indicating seconds.

According to an aspect of the invention, every fifth red "minute" LED is distinct from the intermediate "minute" LEDs in that it is either spaced farther apart from the adjacent LEDs or is larger than the adjacent LEDs, or both.

According to a feature of the invention, a switch is provided in the timing circuit of the timepiece to select between a "normal" mode of operation wherein the sixty "minute" LEDs are energized in sequence, at the passage of each minute and a "teaching" mode of operation wherein only every fifth "minute" LED is energized, in sequence, at the passage of each five minute interval.

The timepiece may be a watch, a clock or the like.

Other objects features and advantages of the invention will become evident in light of the following description thereof.

DETAILED DESCRIPTION OF THE INVENTION

Figure 1:
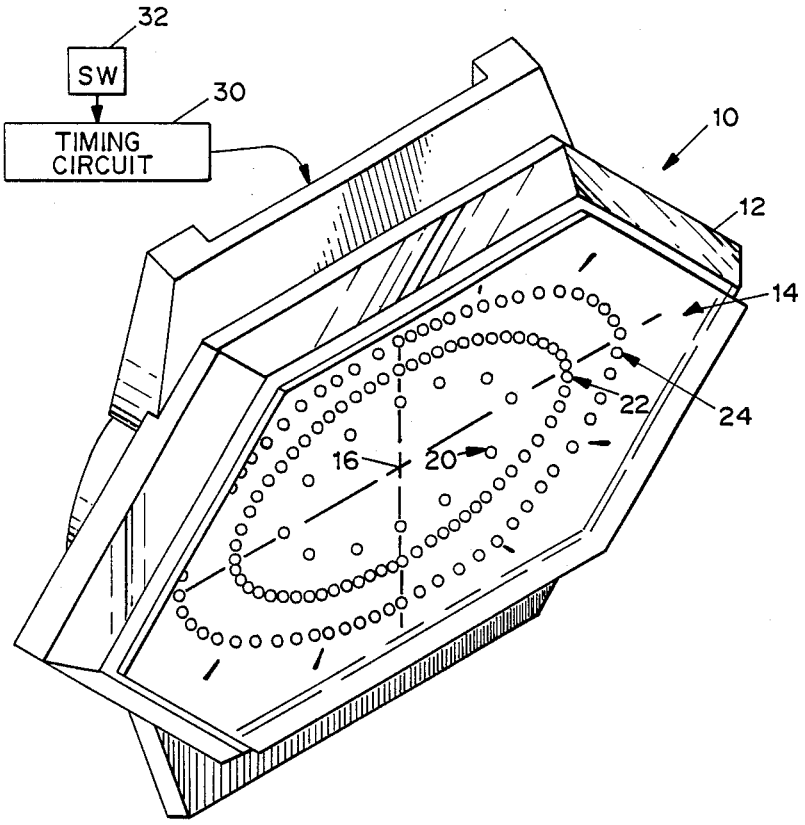
FIG. 1 is a view, partially in perspective and partially in schematic, of the invention.

FIG. 1 shows a timepiece, such as a wrist watch 10. The watch has a housing 12, the shape of which is not pertinent to this invention, and a dial 14, which is a planar surface. It will become evident that the dial is preferably a light color, such as white, ivory or bone. The dial has a center 16.

Three rows, or arrays, of light emitting diodes (LEDs) are arranged on the dial in the following manner. A first, innermost row of twelve LEDs 20 are evenly-spaced, every thirty degrees, in a circular pattern about the center of the dial. These LEDs, which are intended to indicate the hour of day, from one to twelve, are preferably blue LEDs.

A second, next outermost row of sixty LEDs 22 are arranged in a circular pattern about the center of the dial, concentric with the first row of LEDs. The second row of LEDs, which are intended to indicate the minute within each hour, from one to sixty (zero to fifty nine), are preferably red LEDs. Red is chosen to indicate minutes because of its high visibility, the human eye being most sensitive to this color. The second row of LEDs is not necessarily evenly spaced, i.e. every six degrees, about the center of the dial, nor are these LEDs necessarily uniform in size, both of which features will be discussed in greater detail hereinafter.

A third, next outermost row of sixty LEDs 24 are arranged in a circular pattern about the center of the dial, concentric with the first and second rows of LEDs. The third row of LEDs, which are intended to indicate the second within each minute, from one to sixty (zero to fifty nine), are preferably green LEDs, and are preferable evenly-spaced, every six degrees, about the center of the dial.

A timing circuit 30 is provided in the timepiece to energize all of the LEDs in sequence. The details of operation of such a timing circuit are well known in the art, such as in the aforementioned U.S. Pat. No. 4,207,734.

As mentioned hereinbefore, the blue LEDs (hours) and the green LEDs (seconds) are preferably evenly-spaced about the center of the dial and uniform in size.

On the other hand, the red LEDs (minutes) are preferably not evenly-spaced or uniform in size. It has been noted, from a psychological viewpoint, that most people are generally aware of the hour and not very concerned with the second, but are most interested in the minute. However, with regard to minutes, the interest does not parallel the precision of the timepiece. In other words, it is usually the nearest five minute increment that is of interest. It will further be noted that since the dial lacks the traditional markings (from "1" to "12" or "3", "6", "9" and "12"), it is desired to provide some sort of visual indication of the position of the illuminated LEDs about the dial.

With regard to providing a visual clue as to the orientation of an illuminated LED, every fifth red LED 22 is somewhat, such as 10–25% larger in diameter than those inbetween. These larger red LEDs are disposed at positions about the dial corresponding to where the markings "1" to "12" would ordinarily be found. In the case of every fifth red LED being larger, the red LEDs may be uniformly spaced about the center of the dial, i.e. every six degrees.

Alternatively, all of the red LEDs are uniform in size, but every fifth red LED is spaced somewhat farther from the adjacent red LEDs, on either side of it than are the intermediate (2nd–4th, 6th–9th, etc.) LEDs. For example, every fifth LED is spaced seven degrees from the LED on either side of it, and the intermediate LEDs are spaced $5\frac{1}{3}$ degrees apart. In other words, every fifth LED is spaced farther apart, such as by 10–30%, from an adjacent LED than are the intermediate LEDs.

Turning now to the multimode operation of the timepiece 10, a switch 32 is associated with the timing circuit 30. In the normal mode of operation, the red LEDs are energized in sequence, from one to sixty, according to what minute within the hour it is. In an alternate, "teaching" mode of operation, only every fifth red LED (fifth, tenth, etc.) is energized, sequentially at five minute intervals within the hour. This, of course reduces the precision of the timepiece to five minute rather than one, but does not impact upon its accuracy. Before entering the "teaching" mode, it is advantageous to set the time to the correct minute in the normal mode of operation.

The switch 32 is provided in any suitable manner, such as a push-push miniature switch on the side of a wrist watch housing. The manner in which the switch causes the timing circuit to energize only every fifth "minute" LED will be readily implemented by one of ordinary skill in the art to which this invention pertains.

As a final note on the "teaching" mode of operation, the "breakpoints" at which the minute indication sequences from, for instance, from five minutes to ten minutes, is are typically established at the midpoint of two successive indications, e.g. at $7\frac{1}{2}$ minutes. However, if the particular application requires different breakpoints to be implemented, they may be set accordingly, such as closer to the higher or the lower of the successive five-minute indications.

It should be understood that colors combinations other than blue, red and green may be selected for the "hour" LEDs, the "minute" LEDs and the "second" LEDs, respectively. The primary concern is that they be distinctly different colors, and that they show up well against the background of the dial.

It should also be understood that the arrays of LEDs may be arranged in other than a circular pattern.

It should also be understood, insofar as the features of having every fifth "minute" LED either larger or farther from the adjacent "minute" LEDs, and insofar as having only every fifth "minute" LED illuminated in the "teaching" mode, that the differential coloring scheme (blue, red and green, as described above) is not particularly necessary. These features of having every fifth "minute" LED either larger, farther or selectively illuminated in the teaching mode are collectively termed a "distinguishing characteristic" of every fifth LED.

Figure 2:
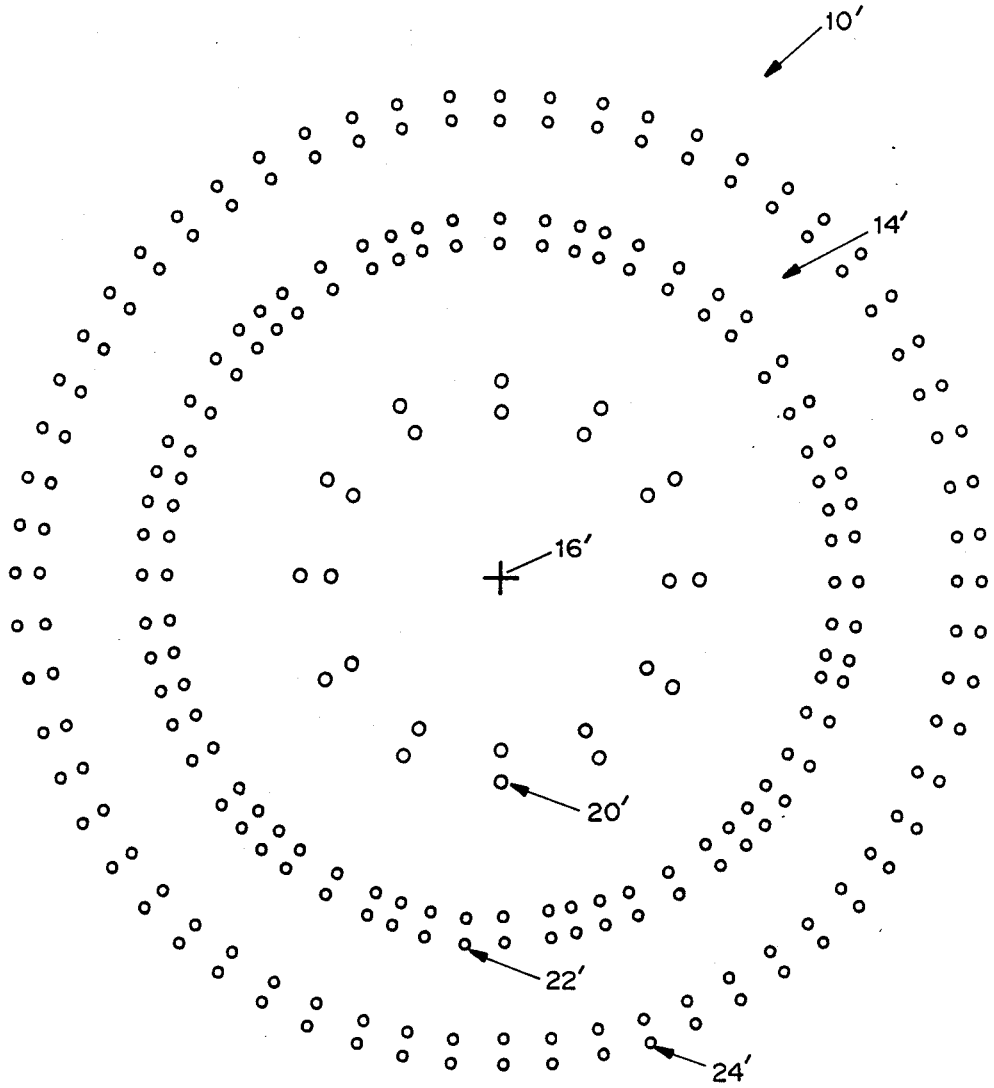
FIG. 2 is a plan view of a timepiece dial (face) according to the present invention.

FIG. 2 shows a dial 14' of a timepiece 10', such as a clock. Herein, each element in the LED arrays, namely the LEDs 20' in the hour array, the LEDs 22' in the minute array and the LEDs 24' in the second array, is two LEDs which are closely spaced, such as by 1–3 diameters of an LED. The pairs of such LEDs are oriented along a radial line from the center 16' of the dial 14'. The timing circuit 30 of FIG. 1 is employed, but not shown. In FIG. 2 it is evident that every fifth minute LED 22' is spaced farther apart from adjacent LEDs than are the intervening minute LEDs. The other distinguishing characteristics of every fifth minute LED, as discussed with reference to FIG. 1, are equally applicable to the "paired" LED embodiment shown in FIG. 2.

In a further functioning mode of the timepiece, the switch 32 is operable to select a "date mode" for the timepiece wherein the hour LEDs 20 or 20' indicate the month, and the minute LEDs 22 or 22' indicate the day. One skilled in the art to which this invention pertains will understand the implementation of this mode. (Only the first 31 of the 60 minute LEDs are employed in the date mode.)

I claim:

1. In a timepiece, a display comprising:

means for generating timing signals;

a first array of elements illuminable in sequence in response to the timing signals to indicate hours;

a second array of sixty elements illuminable in sequence in response to the timing signals to indicate minutes; and switch means for selecting between a normal mode of operation wherein the sixty elements of the second array are illuminated sequentially to indicate the passage of minutes in one-minute increments and a teaching mode of operation wherein only every fifth element of the second array is illuminated sequentially to indicate the passage of minutes in five-minute increments.

2. A display according to claim 1, wherein:

the first array of elements are arranged in a circle about the center of a dial; and the second array of elements are arranged concentrically about the first array of elements.

3. A display according to claim 1:

wherein every fifth element in the second array is distinguished from the intermediate elements in the second array by at least one of the following distinguishing characteristics:

every fifth element in the second array is larger than the intermediate elements in the second array; or every fifth element in the second array is spaced farther from an adjacent element than the intermediate elements in the second array.

every fifth element in the second array is larger than the intermediate elements in the second array;

4. A timepiece display according to claim 3, wherein each of the sixty elements in the second array is two radially spaced-apart elements.

* * * * *